United States Patent [19]

Koerner et al.

[11] 4,137,179

[45] Jan. 30, 1979

[54] PROCESS FOR THE PRODUCTION OF AN AQUEOUS PREPARATION FOR SHRINK-PROOFING WOOL

[75] Inventors: Götz Koerner, Essen; Hans-Jürgen Patzke, Gelsenkirchen-Resse, both of Fed. Rep. of Germany

[73] Assignee: TH. Goldsmith AG, Essen, Fed. Rep. of Germany

[21] Appl. No.: 814,911

[22] Filed: Jul. 12, 1977

[30] Foreign Application Priority Data

Jul. 21, 1976 [GB] United Kingdom ..... 30404/76

[51] Int. Cl.[2] ..... D06M 13/10

[52] U.S. Cl. ..... 252/8.6; 8/115.6; 106/287.14; 260/29.2 M

[58] Field of Search ..... 252/8.6; 8/115.6 A; 106/287 SB; 260/29.2 M, 448.8 R

[56] References Cited

U.S. PATENT DOCUMENTS

| | | | |
|---|---|---|---|
| 2,541,154 | 2/1951 | Clapsadle | 260/448.8 R |
| 2,588,365 | /1952 | Dennett | 260/29.2 M |
| 3,661,964 | 5/1972 | Griffiths et al. | 260/448.8 R |
| 3,837,876 | 9/1974 | Mayuzumi et al. | 106/287 SB |
| 3,981,898 | 9/1976 | Lohse et al. | 260/448.8 R |

*Primary Examiner*—William E. Schulz

*Attorney, Agent, or Firm*—Toren, McGeady and Stanger

[57] ABSTRACT

A new method for producing a stable, aqueous preparation of compounds which are organosiloxanes having amino groups attached to the silicon atoms which are used for the shrink-proofing of wool which preparations contain silanes which may be aminodi- or trialkoxysilanes is disclosed. Composition and the method of treatment of wool are also disclosed. Wool treated with the preparations exhibit excellent decreased shrinkage as well as an absence of felting.

19 Claims, No Drawings

PROCESS FOR THE PRODUCTION OF AN AQUEOUS PREPARATION FOR SHRINK-PROOFING WOOL

BACKGROUND OF THE INVENTION

1. Field of the Invention

The invention relates to a process for the production of a stable, aqueous preparation of compounds which are organosiloxanes having amino groups attached to the silicon atoms for shrink-proofing wool.

2. Description of the Prior Art

It is well known that wool, in the untreated state, shrinks and felts on being washed in aqueous liquor. In order to counteract this shrinkage and felting, chemical treatments have already been recommended in which the structure of the wool is changed, or finishes have been used which contain resin that deposits on the surface of the wool fibers and envelopes the fibers. With both processes, however, products are obtained whose so-called "hand" or aesthetic feel is unpleasant to the consumer.

It has also been recommended that the shrinkage of wool on washing can be reduced by treatment with organosilicon compounds. Such processes are described in British Pat. No. 594,901, 613,267 and 629,329. According to these processes, the wool is treated with certain silanes. A process is described in British Pat. No. 746,307 for preventing the shrinkage of wool whereby the wool fibers are finished with specific silanes. Although a certain degree of shrink-proofing is achieved with this process, the effect is not wash-proof.

In a series of further publications, e.g., German Offenlegungsschriften No. 2,242,297, 2,335,751 and 2,523,270, processes are disclosed for shrink-proofing keratinous fibers by applying organopolysiloxanes, a significant characteristic of these processes being the amino-group content of the compounds. The process according to German Offenlegungsschrift No. 2,242,297 is, for example, characterized by the fact that organopolysiloxanes are used that have units of the general formula $$R_nSiO_{4-n/2}$$

in which $n$ has an average value of 1.9 to 2.1 and

R is an organic residue, connected to silicon via a silicon-carbon bond, whereby 0.25 to 50% of the R substituents are monovalent residues with fewer than 30 carbon atoms, which contain at a distance of at least 3 carbon atoms from the silicon atom, at least one imino group and at least one primary or secondary amino group $—NX_2$, in which X is a hydrogen atom, an alkyl group with 1 to 30 carbon atoms, or an aryl group and whereby the remaining R substituents are monovalent hydrocarbon residues, halogenated hydrocarbon residues, carboxyalkyl residues or cyanoalkyl residues with 1 to 30 carbon atoms of which at least 70% consist of monovalent hydrocarbon residues with 1 to 18 carbon atoms.

From German Offenlegungsschrift No. 2,235,751 a process for treating keratinous fibers is known which is characterized by the fact that the organopolysiloxane composition is obtained by mixing (A) a polydiorganosiloxane with terminal hydroxy groups attached to silicon atoms and a molecular weight of at least 750, in which at least 50% of the organic substituents of the polydiorganosiloxane are methyl groups and in which the other substituents are monovalent hydrocarbon groups with 2 to 30 carbon atoms and (B) an organo silane of the general formula $$RSiR'_nX_{3-n}$$

in which

R is a monovalent group composed of carbon, hydrogen, nitrogen and oxygen, that contains at least two amino groups and is connected to silicon by a silicon-carbon bond, R' is an alkyl group or an aryl group, X are alkoxy groups with 1 to 4 carbon atoms inclusive, and $n$ is zero or 1, and/or contains a partial hydrolysate and condensate of the organo-silane containing product.

It is stated in this German Offenlegungsschrift that the two components of the mixture should be reacted if they are to be applied from an aqueous medium. Practical experiments have, however, shown that it is not possible to produce stable, aqueous emulsions from such reaction products. Gel-like reaction products result which cannot be converted into an emulsion. They are, therefore, unsuitable for shrink-proofing wool.

Thus, one of the major disadvantages of these known processes is that the organosilicon compounds must be applied as a dispersion or as a solution in a volatile organic carrier. Organic solvents, such as, hydrocarbons and halogenated hydrocarbons, such as, benzene, hexane and perchloroethylene are mentioned as suitable carriers. In many mills, however, as well as in the case of a later finishing treatment in the home, the use of organic solvents is not possible. In addition, for reasons of environmental protection, it is desirable to avoid the use of organic solvents wherever possible.

SUMMARY OF THE INVENTION

It is therefore an object of the present invention to create stable, aqueous preparations of organosilicon compounds which are suitable for finishing wool fibers without the need for additional catalysts and softeners.

The object of the invention is achieved by adding aminodi- and/or trialkoxysilanes to an emulsion of a dimethylpolysiloxanediol of a viscosity from 1000 to 100,000 cP at 20° C. in such amounts that in every case, there are 25 to 1000 dimethylsiloxy units per mole of aminosilane.

Stable emulsions produced by the process of the present invention thereby provide unique advantages in the treatment of wool.

DESCRIPTION OF THE PREFERRED EMBODIMENT

Especially preferred is a preparation in which 1 mole of aminosilane corresponds to every 40 to 160 dimethylsiloxy units. A preparation in which 1 more of aminosilane corresponds to every 60 to 100 dimethylsiloxy units is particularly preferred.

The production of the emulsion of dimethylpolysiloxanediol, which preferably contains 5 to 30 wt% of dimethylpolysiloxanediol, can take place according to various processes of the state of the art. One can either start with a dimethylpolysiloxanediol of the desired viscosity, mix this with emulsifiers and add it to water with vigorous stirring or work water into the siloxane-emulsifier mixture. It is recommended that the emulsion so obtained, be homogenized mechanically.

As emulsifiers, the well-known nonionic emulsifiers based on ethylene oxide derivatives and anionic or cationic emulsifiers can be used. As cationic emulsifiers, the quaternary ammonium compounds, such as, for example, dialkylammonium hydroxide, have particularly proven their value. The alkyl residues of these compounds contain 8 to 18 carbon atoms. The emulsifier content, based on the organosilicon compounds, generally amounts to 3 to 10 wt%.

It is, however, also possible and preferred to produce the dimethylpolysiloxanediols in situ by polymerizing cyclic dimethylpolysiloxanes into emulsion form by alkaline catalysis in the presence of the above-mentioned surface-active quaternary ammonium hydroxides, as described, for example, in German Auslegeschrift No. 1,296,311. The desired emulsion of dimethylpolysiloxanediol is formed here in the course of the polymerization of the starting compound. As starting compounds, especially cyclic trisiloxane and/or tetrasiloxane are used.

Instead of the cyclic dimethylsiloxanes, dialkoxysilanes whose alkoxy residues are linear or branched and have 1 to 4 carbon atoms may also be used. The emulsion polymerization is preferably carried out at elevated temperatures up to 95° C.

In the inventive process, aminodialkoxysilanes and/or aminotrialkoxysilanes are added to the desired dimethylpolysiloxanediol emulsion in such amounts that 1 mole of aminosilane corresponds to every 25 to 1000 dimethylsiloxy units. The preferred ratio ranges are those in which 1 more of aminosilane corresponds to 40 to 160, and especially, 60 to 110 dimethylsiloxy units.

The amino group in the amino silane used should be linked to a silicon atom via one or more carbon atoms. As the aminoalkoxysilane, 3-(2-aminoethyl-)aminopropyltrimethoxysilane is especially suitable. Further suitable aminoalkoxysilanes are 3-aminopropyltrimethoxysilane, and 3-(2-aminoethyl-)aminopropylmethyldimethoxysilane. In application, the trialkoxysilanes have shown themselves to be better than the dialkoxysilanes.

It was surprising to those skilled in the art that stable, aqueous preparations can be obtained by the inventive procedure. One would have assumed, from the state of the art, that a conversion would have occurred as a result of the reaction of aminodialkoxysilane and/or aminotrialkoxysilane with the emulsified dimethylpolysiloxanediol that would have led to a gelling of the product. For example, it is stated in the journal "Textile Institute and Industry" 1976, page 344, that aminoalkoxysilanes, as cross-linking agents in aqueous solution, hydrolyze quickly and form polymers. In contrast, however, the inventively produced preparation has shown itself to be stable on storage without phase separation and has, therefore, proven itself to be particularly useful in application.

Before use, the preparations may be diluted and adjusted to the pH range desired. The concentration of the liquor and the dwell time of the textile in the liquor are selected such that after squeezing off the excess treatment fluid on the fibers to be treated, 0.1 to 10 and especially, 0.1 to 5 wt.% of the organosiloxane compounds, based on the weight of the fiber, remain.

As used herein, the term wool is understood to include keratin fibers in general, i.e., fibers of animal hair. These include sheep wool, mohair, cashmere, and others. The wool may be present in the form of fibers, yarns, woven or knitted material.

The object of the present invention is illustrated in greater detail by means of the following examples.

EXAMPLE 1

After adding 4870 g of water to a reaction vessel, an emulsifier solution is added which is composed of 50 g of didecyldimethylammonium chloride, 50 g of water and 26 g of isopropanol. The addition of 50 g of 1-molar potassium hydroxide solution follows with stirring. The contents of the flask are now heated to an internal temperature of 95° C. At this temperature and while stirring vigorously, 866.4 g (2.92 moles) of octamethylcyclotetrasiloxane are added from a dropping funnel within 15 minutes. A one hour additional stirring phase at the same temperature follows. Now, 23.6 g (0.106 mole) of 3-(2-aminoethyl) aminopropyltrimethoxysilane (mole ratio of dimethylsiloxy units: aminosilane = 110:1) are added dropwise, also within 15 minutes at an internal temperature of 95° C. Vigorous stirring is then continued for a further 30 minutes at 95° C. Subsequently, the contents of the flask are brought to 60° C. during one hour while cooling with stirring. After the stirrer has been turned off, the mixture is allowed to stand for 20 hours. Subsequently, 320 g of 0.5N hydrochloric acid are added dropwise at room temperature during 15 minutes while stirring. The emulsion, thus prepared contains very few gel particles which are removed by a subsequent filtration through a rapid sieve.

The solids content of this stable emulsion is 13.6%.

EXAMPLE 2

An emulsifier solution consisting of 2814 g of water, 42 g of didecyldimethylammonium chloride and 42 g of a 1-molar potassium hydroxide solution, is heated in a suitable reaction vessel with stirring to 95° C. The addition within 15 minutes of a mixture of 721 g (2.43 moles) of octamethylcyclotetrasiloxane and 20 g of isopropanol follows at this temperature. The addition is followed by a one hour additional stirring at the same temperature. 26.2 g (0.118 moles) of 3-(2-aminoethyl) aminopropyltrimethoxysilane are now added dropwise using a dropping funnel. The molar ratio of dimethylsiloxy units to aminosilane amount to 82:1. When the addition has been completed, the mixture is stirred vigorously for a further 30 minutes at 95° C. The emulsion is then cooled to 60° C. and the alkaline solution obtained neutralized by the addition of 60 g of a 10% solution of acetic acid. The solids content of this stable emulsion is 18.6%.

EXAMPLE 3

1937 g of water, 19.5 g of didecyldimethylammonium chloride, 14.5 g of a betaine having the formula $$C_{12}H_{25}CONHCH_2CH_2\overset{\overset{CH_3}{|}}{\underset{\underset{CH_3}{|}}{N}}{}^{\oplus}CH_2COO^{\ominus}.$$

and 50 g of a 1-molar potassium hydroxide solution are added to a reaction vessel and heated with stirring to 95° C. A mixture, consisting of 700 g (2.36 moles) of octamethylcyclotetrasiloxane and 21 g of ethanol are added within 15 minutes by means of a dropping funnel.

The mixture is then stirred vigorously for a further hour. Subsequently, 25.3 g (0.115 moles) of 3-(2-aminoethyl)aminopropyltrimethoxysilane are added dropwise to the emulsion and stirring is continued for a further 30 minutes. The molar ratio of dimethylsiloxy units to amino-silane amounts to 82:1. After cooling to 60° C., the potassium hydroxide that is contained in the emulsion is neutralized by the addition of 80 g of a 10% acetic acid solution.

The emulsion so prepared has a solids content of 24.4%.

Example of the Use of the Emulsion of the Present Invention

A knitted material of fine wool was treated with the emulsions described in the examples in such a way, that, after simply drying the impregnated knitted material, a solids coating of 1% resulted.

The finished material as well as the untreated material were laundered ten times in a domestic washing machine and dried in a tumble drying between launderings.

After ten launderings and dryings, the control material showed a felting area shrinkage of 44% and a strongly felted surface. On the other hand, the treated samples had an average felting area shrinkage of 5% and a completely unchanged appearance. In addition, the hand of the treated material after laundering was significantly softer than the hand of the untreated material after laundering and corresponded to the hand before laundering.

The calculation of felting area shrinkage was carried out according to the following formula:

$$\text{Felting area shrinkage} = L + \%W - \%L \times \%W/100$$

% L = percent longitudinal shrinkage
% W = percent width shrinkage.

What is claimed is:

1. In a process for the production of an aqueous preparation of compounds for shrinkage-proofing wool wherein a dimethylpolysiloxanediol is mixed with emulsifiers and water to form an emulsion, the improvement comprising adding a silane compound selected from the group consisting of aminodialkoxysilanes and aminotrialkoxysilanes wherein the alkoxy portion is methoxy or ethoxy to the emulsion of a dimethylpolysiloxanediol of a viscosity of 1000 to 100,000 cP at 20° C. in such amounts that 1 mole of aminosilane corresponds to every 25 to 1000 dimethylsiloxy units.

2. The process according to claim 1 wherein the silane is added to the emulsion of dimethylpolysiloxanediol in such amounts that 1 mole of aminosilane corresponds to every 40 to 160 dimethylsiloxy units.

3. The process according to claim 1 wherein the silane compound is added to the emulsion of dimethylpolysiloxanediol in such amounts that 1 mole of aminosilane corresponds to every 60 to 100 dimethylsiloxy units.

4. The process according to claim 1 wherein the silane compound has an amino group linked to the silicon atom by a carbon atom or by a chain consisting of several carbon atoms.

5. The process according to claim 4 wherein the silane is selected from the group consisting of 3-(2-aminoethyl-) aminopropyltrimethoxysilane, 3-aminopropyltrimethoxysilane and 3-aminopropyltriethoxysilane.

6. The process according to claim 1 wherein a dimethylpolysiloxanediol emulsion containing 5 to 30% by weight of dimethylpolysiloxanediol is used.

7. A stable aqueous preparation of compounds for shrink-proofing wool comprising organosiloxanes having amino groups attached to the silicon atoms and a silane compound selected from the group consisting of aminodialkoxysilanes and aminotrialkoxysilanes wherein the alkoxy portion is methoxy or ethoxy in an emulsion of a dimethylpolysiloxanediol of a viscosity of 1000 to 100,000 cP at 20° C. in such amounts that 1 mole of aminosilane corresponds to very 25 to 1000 dimethylsiloxy units.

8. The preparation of claim 7 wherein the amount of silane is such that 1 mole of aminosilane corresponds to every 40 to 160 dimethylsiloxy units.

9. The preparation of claim 7 wherein the amount of silane is such that 1 mole of aminosilane corresponds to every 60 to 100 dimethylsiloxy units.

10. The preparation of claim 7 wherein the silane compound has an amino group linked to the silicon atom by a carbon atom or by a chain consisting of several carbon atoms.

11. The preparation of claim 10 wherein the silane is selected from the group of 3-(2-aminoethyl-)aminopropyltrimethoxysilane, 3-aminopropyltrimethoxysilane, and 3-aminopropyltriethoxysilane.

12. The preparation of claim 7 wherein a dimethylpolysiloxanediol emulsion containing 5 to 30% by weight of dimethylpolysiloxanediol is used.

13. In a method for shrink-proofing wool wherein the wool is treated with an aqueous preparation of compounds which are organosiloxanes having amino groups attached to the silicon atoms and then dried, the improvement which comprises said preparation containing a silane compound selected from the group consisting of aminodialkoxysilanes and aminotrialkoxysilanes wherein the alkoxy portion is methoxy or ethoxy in an emulsion of a dimethylpolysiloxanediol of a viscosity of 1000 to 100,000 cP at 20° C. in such amounts that 1 mole of aminosilane corresponds to every 25 to 1000 dimethylsiloxy units.

14. The method of claim 13 wherein the amount of silane is such that 1 mole of aminosilane corresponds to every 40 to 160 dimethylsiloxy units.

15. The method of claim 13 wherein the amount of silane is such that 1 mole of aminosilane corresponds to every 40 to 160 dimethylsiloxy units.

16. The method of claim 13 wherein the silane compound has an amino group linked to the silicon atom by a carbon atom or by a chain consisting of several carbon atoms.

17. The method of claim 16 wherein the silane is selected from the group consisting of 3-(2-aminoethyl-)amino-propyltrimethoxysilane, 3-aminopropyltrimethoxysilane and 3-aminopropyltriethoxysilane.

18. The method of claim 13 wherein a dimethylpolysiloxanediol emulsion containing 5 to 30% by weight of dimethylpolysiloxanediol is used.

19. Wool treated by the method of claim 13.

* * * * *

UNITED STATES PATENT OFFICE

CERTIFICATE OF CORRECTION

Patent No. 4,137,179 Dated January 30, 1979

Inventor(s) GÖTZ KOERNER, HANS-JÜRGEN PATZKE

It is certified that error appears in the above-identified patent and that said Letters Patent are hereby corrected as shown below:

In the heading of the patent [73] should read as follows:

[73] Assignee: TH. Goldschmidt AG, Essen, Fed. Rep. of Germany

Signed and Sealed this

*Eleventh* Day of *September 1979*

[SEAL]

*Attest:*

*Attesting Officer*

LUTRELLE F. PARKER

*Acting Commissioner of Patents and Trademarks*